US005628433A

United States Patent [19]

Binder

[11] Patent Number: 5,628,433

[45] Date of Patent: May 13, 1997

[54] CAULKING TUBE AIR ESCAPE STRUCTURE

[75] Inventor: Frederick Binder, Windsor, Canada

[73] Assignee: Research Plastics Inc., Windsor, Canada

[21] Appl. No.: 641,821

[22] Filed: May 2, 1996

[51] Int. Cl.[6] ..... B65D 88/54

[52] U.S. Cl. ..... 222/327

[58] Field of Search ..... 222/327, 23, 391, 222/526, 575, 562

[56] References Cited

U.S. PATENT DOCUMENTS 2,941,694 8/1960 Harman ..... 222/562

4,768,954 9/1988 Dragan ..... 222/575

4,852,772 8/1989 Ennis, III ..... 222/327

5,249,709 10/1993 Duckworth et al. ..... 222/327

*Primary Examiner*—Philippe Derakshani

*Attorney, Agent, or Firm*—Howard & Howard

[57] ABSTRACT

An improved tube for handling fluent materials such as caulking includes a plurality of ribs that form air escape spaces. The ribs extend inwardly from an inner peripheral wall of the tube for a very small distance. The ribs form an air space between a plunger and the tube allowing air to escape rearwardly of the plunger. In another feature of this invention, a color plastic sleeve is received on a nozzle for the tube to provide an identification of the color of the caulking received within the tube.

14 Claims, 1 Drawing Sheet

CAULKING TUBE AIR ESCAPE STRUCTURE

BACKGROUND OF THE INVENTION

This invention relates to a method of allowing air to escape from a tube for containing a fluent material such as caulking.

In the prior art, fluent materials, such as caulking, adhesives, or other materials, are typically stored in tubes that are generally cylindrical and extend from a rear end to a front nozzle. A plunger is received within the rear end and advanced by a gun to dispense the material from the nozzle. Historically, these tubes have been formed of cardboard. More recently, plastic has started to be used to form the tubes.

Problems exist in storing some types of materials in plastic tubes. As an example, when storing silicone-based caulkings, it is necessary to displace air outwardly of the tube once the plunger is inserted into the tube. The air could cause the silicone caulking to begin to set, which would be undesirable. The prior art has utilized an air tap that includes a needle on the filling machine that moves downwardly into the material to allow the air to escape while inserting the plunger.

This solution is unduly complicated. Moreover, it has not been applied to other types of caulkings. As an example, acrylic latex caulkings need not have the air removed. Thus, the art has not utilized such a complex method step to assist in removing air. Even so, it would be desirable to develop a simple air escape system that could be utilized on all of the different types of materials stored in these tubes.

These tubes also experience complications with undesired after flow of material from the nozzle. In particular, when a dispenser initially stops dispensing, there is sometimes additional forward flow of the material due to air within the tube. This causes some of the material to escape outwardly of the nozzle.

The present invention discloses a way to allow the air to escape between the plunger and the tube, while still maintaining the fluid-tight connection necessary to prevent undue leakage of the caulking or other material rearwardly between the plunger and the tube.

SUMMARY OF THE INVENTION

The present invention discloses a tube for storing caulking or other fluent materials wherein air escape spaces are provided between the plunger and the tube at the rearward end of the tube. In preferred embodiments of this invention, those air escape spaces are provided by ribs on one of the plunger or the tube. In the most preferred embodiment of this invention, the ribs are provided on the tube. The air escape ribs provide a space between the plunger and the tube inner wall in the vicinity of at least the ribs, thus providing a space where air can escape. Air can escape when the plunger is inserted into the tube and can help stop the flow of material when the dispensing operation is interrupted. Thus, the present invention provides a tube that solves the problems mentioned above.

In a most preferred embodiment of this invention, the ribs extend only a small amount into the inner periphery of the tube. It is desirable to allow escape of air. Thus, preferably, the ribs extend for a depth that is less than 1% of the diameter of the tube. More preferably, the ribs only extend for a depth that is less than 0.5% of the diameter of the tube. At the same time, the ribs only occupy a small area of the space within the tube. Preferably, each rib occupies an area less than 1% of the total area within the tube. More preferably, the ribs only occupy less than 0.5% of the total area within the tube. Preferably, there are 4 equally spaced ribs about the inner circumference of the tube.

Preferably, the plunger is sized to provide an interference fit with the inner periphery of the tube. The ribs deform the plunger inwardly locally about the tubes, or alternatively the tube is deformed radially outwardly away from the plunger. At any rate, the air spaces are formed between the plunger and the tube locally in the area of the rib.

In another feature, a plastic sleeve can be snapped onto the nozzle of the inventive tube. The plastic sleeve can be made of the color of the fluent material found within the tube. It is desirable to be able to provide an indication of the color of the material within the tube. However, the prior art has not been able to easily achieve such an indication with simple injection molded tubes. Thus, the present invention use of the sleeve provides valuable benefits.

These and other features of the present invention will be best understood from the following specifications and drawings, of which the following is a brief description.

DETAILED DESCRIPTION OF THE PREFERRED EMBODIMENT

Figure 1:
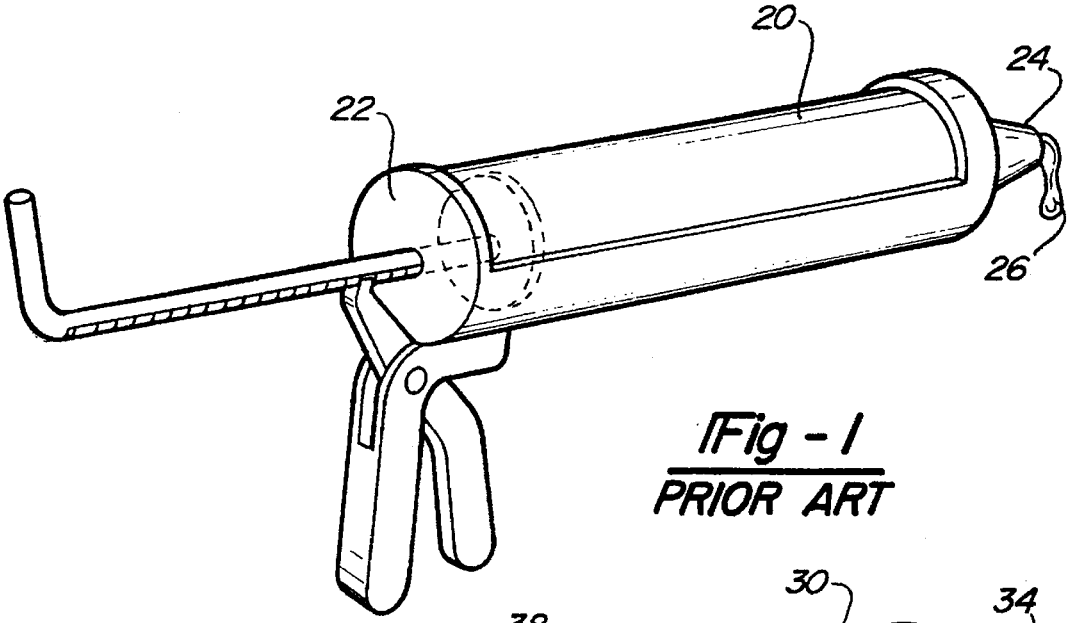
Fig - 1 PRIOR ART
FIG. 1 shows a caulking gun as known in the prior art.

FIG. 1 shows a prior art tube (20) that stores caulking or other fluent material. As known, a gun (22) dispenses material from the tube (20) through its nozzle (24). Occasionally, when dispensing is interrupted, a portion of the material still moves outwardly as shown at (26) from the nozzle (24). This at least partially due to entrapment of air within the tube. This is undesirable.

Figure 2:
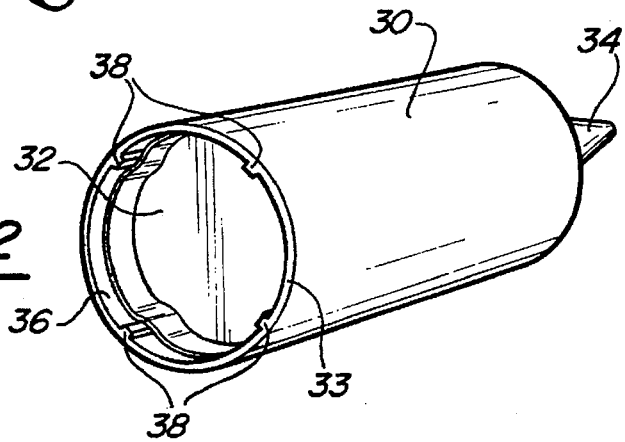
FIG. 2 shows an inventive tube.

FIG. 2 shows an inventive tube (30) directed to facilitating the removal of air upon the initial insertion of plunger (32) into the tube (30) and also to eliminate the unwanted after flow as shown at (26).

As shown, a plunger (32) is received within the rear end (33) of the tube (30). The nozzle (34) is formed at the other end. The inner periphery (36) of the tube (30) is formed with a plurality of radially inwardly extending ribs (38). The ribs (38) form air escape spaces between the plunger (32) and the tube (30) as will be explained in more detail below. The size of the air escape spaces and the ribs are greatly exaggerated in this figure. Their actual size relative to the diameter of the tube will be set forth below. The size of the ribs has been greatly exaggerated to show how they function to provide the air spaces. Preferably, the tube (30) is injection molded from known materials. The ribs (38) are easily formed by modifying the mold utilized to form the injection molded tube (30).

Figure 3:
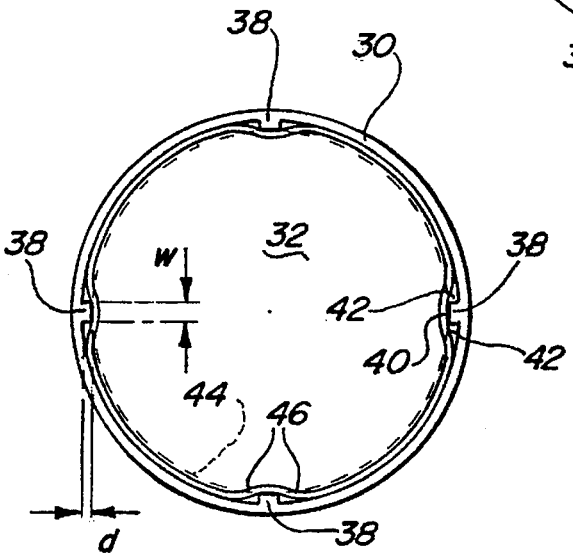
FIG. 3 shows dimensional features of the present invention.

As shown in FIG. 3, tube (30) has ribs (38) extending radially inwardly for a distance d. Each rib also extends for a circumferential distance w. The ribs are shown extending for a greater extent than they would preferably extend in practice. In practice, the ribs are preferably quite small. Again, the size of the ribs (38) in the drawings is greatly exaggerated to show the function of ribs (38). Ribs (38) form a small air escape space between the tube inner wall and plunger (32). The plunger (32) closely fits within the inner periphery (36) of the tube. The ribs locally deform the plunger inwardly, or alternatively the plunger locally deforms the rib and hence the tube radially outwardly. At any rate, in one of these two ways, the small air escape space is formed. However, the amount of that space is desirably minimized to minimize leakage of fluid. In one preferred embodiment, the inner circumference of the tube without the ribs is 5.6875 inches. That is a tube with a diameter of approximately 1.8 inches. In this known tube, the rib extends radially inwardly for 0.003 inch, and extends circumferentially for 0.010 inch width. Thus, the depth or distance d of the ribs (38) is less than 1% of the diameter of the tube. Preferably, the rib is less than 0.5% of the diameter of the tube, and in the actual above disclosed embodiment, it was less than 0.2% of the tube. In fact, the rib (38) extended radially inwardly only 0.167% of the diameter of the tube.

At the same time, the ribs occupy a very small area compared to the area within the tube. In the particular above disclosed embodiment, the area of each rib was 0.00003 inch. The tube otherwise had an approximate inner cross-sectional area of 0.2545 inches. Thus, the area of the rib is less than 1% of the overall area within the tube, and is preferably less than 0.5% of the area within the tube. In fact, the area of the rib is less than 0.2% of the area within the tube, and in the above example, was 0.117% of the overall area within the tube.

As shown in FIG. 3, the plunger (32) preferably has an outer diameter as shown at (40) which provides an interference fit in the inner surface (36) of tube (30). The ribs (38) either locally deform the plunger inwardly (46) providing air escape spaces (42) on each side of each rib, or the plunger deforms the tube outwardly to form the air spaces. Again, the depth of the ribs is quite small such that the amount of space (42) and the amount of deformation shown in FIG. 3 is greatly exaggerated.

Figure 4:
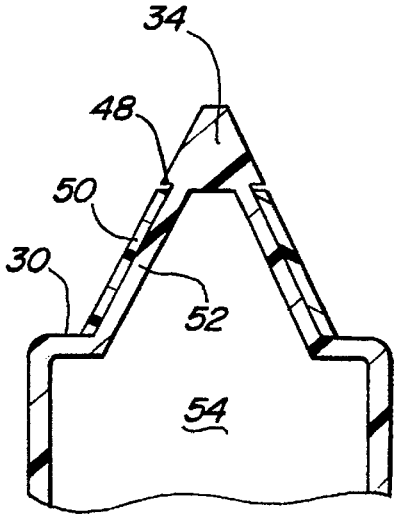
FIG. 4 shows another feature of the present invention.

FIG. 4 shows yet another feature of the present invention. As shown in FIG. 4, nozzle (34) has an outwardly extending ledge (48). A portion (52) extends from ledge (48) downwardly to the remainder of the body of the tube (30). A sleeve (50) is snapped beneath the ledge (48). Sleeve (50) is formed of a color plastic such that it matches the approximate color of the fluent material (54) found within the tube (30). An injection molded tube (30) can now be utilized that can easily be modified to contain an indication of the color of the caulking (54) within the tube (30). The prior art has had some difficulty in being able to match the several potential colors of material (54) that could be received within tube (30) with some outward visual indication. The present invention provides a way of achieving that indication while still utilizing a simple injection molded tube.

Preferably the tube is injected molded from plastics that are known for forming caulking tubes. The inventive tube not only improves air escape in plastic tubes, but also improves the ability to provide color indication for injection molded tubes.

A preferred embodiment of this invention has been disclosed. However, a worker of ordinary skill in the art would recognize that certain modifications would come within the scope of this invention. For that reason, the following claims should be studied to determine the true scope and content of this invention.

I claim:

1. A tube for receiving a fluent material comprising:

a tube body being elongated and extending from a rear end to a forward nozzle end;

a plunger member received within said tube body adjacent said rear end; and said plunger body having an outer peripheral surface closely matched to an inner peripheral surface of said hollow tube body, air spaces being formed between said outer peripheral surface of said plunger and said inner peripheral surface of said tube body, said air spaces defined adjacent said rear end of said tube body by air space defining members extending to said rear end, said tube body having a diameter, said air space defining members having a radial distance that is less than 1.0% of said diameter of said tube, and each of said air space defining members occupying an area that is less than 0.5% of the area of the interior of said tube.

2. A tube as recited in claim 1, wherein said air spaces are formed by ribs extending from one of said inner peripheral surface of said tube and said outer peripheral surface of said plunger.

3. A tube as recited in claim 2, wherein said ribs are formed to extend radially inwardly from said inner peripheral surface of said tube.

4. A tube as recited in claim 1, wherein said ribs extend inwardly for a distance that is less than 0.5% of the diameter of the tube.

5. A tube as recited in claim 4, wherein said rib extends radially inwardly for a depth that is less than 0.2% of the diameter of the tube.

6. A tube as recited in claim 3, wherein there are four of said ribs spaced about said inner periphery of said tube.

7. A tube as recited in claim 3, wherein said plunger outer peripheral surface is interference fit within said inner peripheral surface of said hollow tube body, and said ribs locally deform one of said plunger and said hollow tube body to create said air spaces.

8. A tube as recited in claim 1, wherein the material received within said tube is caulking.

9. A tube as recited in claim 1, wherein a sleeve is received on said nozzle, said sleeve being color-coded to match the color of the material within said tube.

10. A tube for receiving a fluent material comprising:

a hollow tube body being generally cylindrical and extending from a rear end to a nozzle end, a plurality of ribs extending radially inwardly from an inner peripheral wall of said tube, said ribs extending radially inwardly for a depth that is less than 0.5% of a diameter of said tube; and a plunger having an outer peripheral surface closely matched to said inner peripheral surface of said tube, such that when said plunger is received within said tub, air spaces are formed between said plunger and said tube by said ribs, said ribs each occupying an area that is less than 0.5% of the area of said tube, and said ribs extending to said rear end of said hollow tube body.

11. A tube as recited in claim 10, wherein said tube holds a caulking material.

12. A tube as recited in claim 11, wherein there are four of said ribs spaced circumferentially about said inner peripheral surface of said tube.

13. A tube as recited in claim 10, wherein a separate plastic sleeve is received on said nozzle, said sleeve being color-coded to match the color of the material to be dispensed into said tube.

14. A tube as recited in claim 13, wherein said sleeve is snapped beneath a ledge formed on said nozzle to retain said sleeve on said nozzle.

* * * * *